US012180827B2

(12) United States Patent
Al Madan

(10) Patent No.: US 12,180,827 B2
(45) Date of Patent: Dec. 31, 2024

(54) TRANSIENT PRESSURE DATA ANALYSIS TO DETERMINE CONTRIBUTING INFLOW CONTROL DEVICES

(71) Applicant: Saudi Arabian Oil Company, Dhahran (SA)

(72) Inventor: Mohammed H. Al Madan, Al Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 367 days.

(21) Appl. No.: 17/689,689

(22) Filed: Mar. 8, 2022

(65) Prior Publication Data

US 2023/0287783 A1 Sep. 14, 2023

(51) Int. Cl.
*E21B 47/06* (2012.01)
*E21B 47/09* (2012.01)
*E21B 47/12* (2012.01)

(52) U.S. Cl.
CPC ..... *E21B 47/06* (2013.01); *E21B 47/09* (2013.01); *E21B 47/12* (2013.01)

(58) Field of Classification Search
CPC ..... E21B 47/06; E21B 47/09; E21B 47/12; E21B 43/12; E21B 43/14
See application file for complete search history.

(56) References Cited

U.S. PATENT DOCUMENTS 1,843,217 A 2/1932 Fletcher
2,874,781 A 2/1959 McGaffey
(Continued)

FOREIGN PATENT DOCUMENTS

CA 2719792 6/2015
CN 102754105 10/2012
(Continued)

OTHER PUBLICATIONS

Falcone et al., "Model Predicts More Accurate PI Over a Field's Life," Oil and Gas Journal, Pennwell Houston, Texas, vol. 99, No. 12, Mar. 19, 2001, 5 pages.
(Continued)

*Primary Examiner* — Catherine T. Rastovski
*Assistant Examiner* — Yossef Korang-Beheshti
(74) *Attorney, Agent, or Firm* — Fish & Richardson P.C.

(57) ABSTRACT

A computer-implemented method, medium, and system for determining contributing inflow control devices (ICDs) using transient pressure data from a permanent downhole monitoring system (PDHMS) in a wellbore is disclosed. One example computer-implemented method includes receiving transient pressure data from a PDHMS in the wellbore. Multiple ICDs are installed in the wellbore and include multiple contributing ICDs that contribute to fluid flow in the wellbore. Curve fitting of multiple composite exponential signals is performed to match the transient pressure data. A total number of the multiple contributing ICDs is determined based on a result of performing the curve fitting. A respective normalized distance between each pair of adjacent ICDs of the multiple contributing ICDs is determined. A depth of a last ICD in the multiple contributing ICDs is determined. A list of all contributing ICDs is generated based on the determination of the depth of the last ICD.

20 Claims, 7 Drawing Sheets

(56) References Cited

U.S. PATENT DOCUMENTS

| | | | | |
|---|---|---|---|---|
| 5,139,089 | A | 8/1992 | Wacker | |
| 5,871,047 | A | 2/1999 | Spath et al. | |
| 6,719,056 | B2 | 4/2004 | Hoffman et al. | |
| 7,478,024 | B2 | 1/2009 | Gurpinar et al. | |
| 9,745,833 | B2 | 8/2017 | Carvajal et al. | |
| 9,951,583 | B2 | 4/2018 | Gosselin et al. | |
| 10,133,831 | B2 | 11/2018 | Carvajal et al. | |
| 2007/0012455 | A1* | 1/2007 | Smithson | E21B 34/16 166/375 |
| 2007/0016389 | A1 | 1/2007 | Ozgen et al. | |
| 2007/0198234 | A1 | 8/2007 | Zangi et al. | |
| 2010/0023269 | A1 | 1/2010 | Yusti et al. | |
| 2010/0299125 | A1 | 11/2010 | Ding et al. | |
| 2013/0035920 | A1 | 2/2013 | Al-Shammari | |
| 2016/0102546 | A1* | 4/2016 | Xu | E21B 47/11 137/551 |
| 2017/0114619 | A1 | 4/2017 | Conn et al. | |
| 2018/0171761 | A1 | 6/2018 | Schneider et al. | |
| 2018/0188403 | A1 | 7/2018 | Halsey et al. | |
| 2018/0230780 | A1 | 8/2018 | Klenner | |
| 2018/0371903 | A1* | 12/2018 | Li | E21B 47/06 |
| 2019/0055813 | A1* | 2/2019 | Greci | E21B 43/08 |
| 2020/0224528 | A1* | 7/2020 | Fripp | E21B 47/01 |

FOREIGN PATENT DOCUMENTS

| | | | | |
|---|---|---|---|---|
| CN | 103842615 | | 6/2014 | |
| CN | 105493100 | | 4/2016 | |
| CN | 105706089 | | 6/2016 | |
| CN | 107795309 | A * | 3/2018 | E21B 43/243 |
| EP | 2951720 | | 12/2015 | |
| FR | 2950993 | | 4/2011 | |
| WO | WO 2013130551 | | 9/2013 | |
| WO | WO 2016010813 | | 1/2016 | |
| WO | WO 2016186627 | | 11/2016 | |
| WO | WO 2017040457 | | 3/2017 | |
| WO | WO 2017074883 | | 5/2017 | |
| WO | WO 2017111964 | | 6/2017 | |
| WO | WO 2017151838 | | 9/2017 | |
| WO | WO 2017165949 | | 10/2017 | |
| WO | WO 2018132786 | | 7/2018 | |

OTHER PUBLICATIONS

Putra et al., "Recovering Well Productivity in Banyu Urip Field," SPE Asia Pacific Oil & Gas Conference and Exhibition, Jakarta, Indonesia, Oct. 22-24, 2013, SPE 165793, Oct. 22, 2013, 8 pages.

Sawyer et al., "A simulation-based spreadsheet program for history matching and forecasting shale gas production" SPE 57439, Oct. 1999, 8 pages.

Siu et al., "Re-Engineering the Well Calibration Procedure for a Large No. of High Productivity Wells," SPE 66385, Proceedings of SPE Reservoir Simulation Symposium, Jan. 1, 2001, 14 pages.

* cited by examiner

500

600

TRANSIENT PRESSURE DATA ANALYSIS TO DETERMINE CONTRIBUTING INFLOW CONTROL DEVICES

TECHNICAL FIELD

The present disclosure relates to computer-implemented methods, medium, and systems for determining contributing inflow control devices using transient pressure data from a permanent downhole monitoring system in a wellbore.

BACKGROUND

Inflow control devices (ICDs) installed in a wellbore are used to maintain uniform fluid flow in the wellbore. Depending on the fluid flow in the wellbore, some ICDS help maintain uniform fluid flow in the wellbore, and therefore contribute to the fluid flow, while other ICDs do not contribute to the fluid flow. To determining the ICDs that contribute to the fluid flow, production logging tool (PLT) based methods can be used, but these methods can be costly.

A permanent downhole monitoring system (PDHMS) installed in a wellbore can be used for reservoir modeling and production strategies. Transient pressure data can be collected from the PDHMS for post processing.

SUMMARY

The present disclosure involves computer-implemented method, medium, and system for determining contributing inflow control devices (ICDs) using transient pressure data from a permanent downhole monitoring system (PDHMS) in a wellbore. One example computer-implemented method includes receiving transient pressure data from a PDHMS in the wellbore, where the transient pressure data is a function of time. Multiple ICDs are installed in the wellbore. The multiple ICDs include multiple contributing ICDs that contribute to fluid flow in the wellbore, and n is a total number of the multiple ICDs. Curve fitting of m composite exponential signals is performed to match the transient pressure data, where m is less than or equal to n, and m is determined during the curve fitting. A total number of the multiple contributing ICDs in the multiple ICDs is determined based on a result of performing the curve fitting of the m composite exponential signals to match the transient pressure data. A respective normalized distance between each pair of adjacent ICDs of the multiple contributing ICDs is determined based on the total number of the multiple contributing ICDs. A depth of a last ICD in the multiple contributing ICDs is determined based on the determined respective normalized distance between each pair of adjacent ICDs of the multiple contributing ICDs. A list of all ICDs in the multiple ICDs that contribute to the fluid flow of the wellbore is generated based on the determination of the depth of the last ICD. The list of all ICDs in the multiple ICDs that contribute to the fluid flow of the wellbore is provided for determination of candidates for production logging tools or for determination of whether shifting jobs performed by the multiple ICDs are successful.

While generally described as computer-implemented software embodied on tangible media that processes and transforms the respective data, some or all of the aspects may be computer-implemented methods or further included in respective systems or other devices for performing this described functionality. The details of these and other aspects and implementations of the present disclosure are set forth in the accompanying drawings and the description below. Other features, objects, and advantages of the disclosure will be apparent from the description and drawings, and from the claims.

DETAILED DESCRIPTION

To reduce the cost associated with PLT based methods for determining contributing ICDs, transient pressure data from a PDHMS in a wellbore can be used to predict contributing ICDs and ICDs that do not contribute to fluid flow in the wellbore. The predicted contributing ICDs can be used to determine the PLT candidates systematically, and to test whether shifting jobs performed by ICDs in the wellbore are successful.

This disclosure describes technologies for determining contributing ICDs using transient pressure data from a PDHMS in a wellbore. In some implementations, transient pressure data from the PDHMS in the wellbore is used together with composite exponential signal models to predict contributing ICDs in the wellbore.

Figure 1:
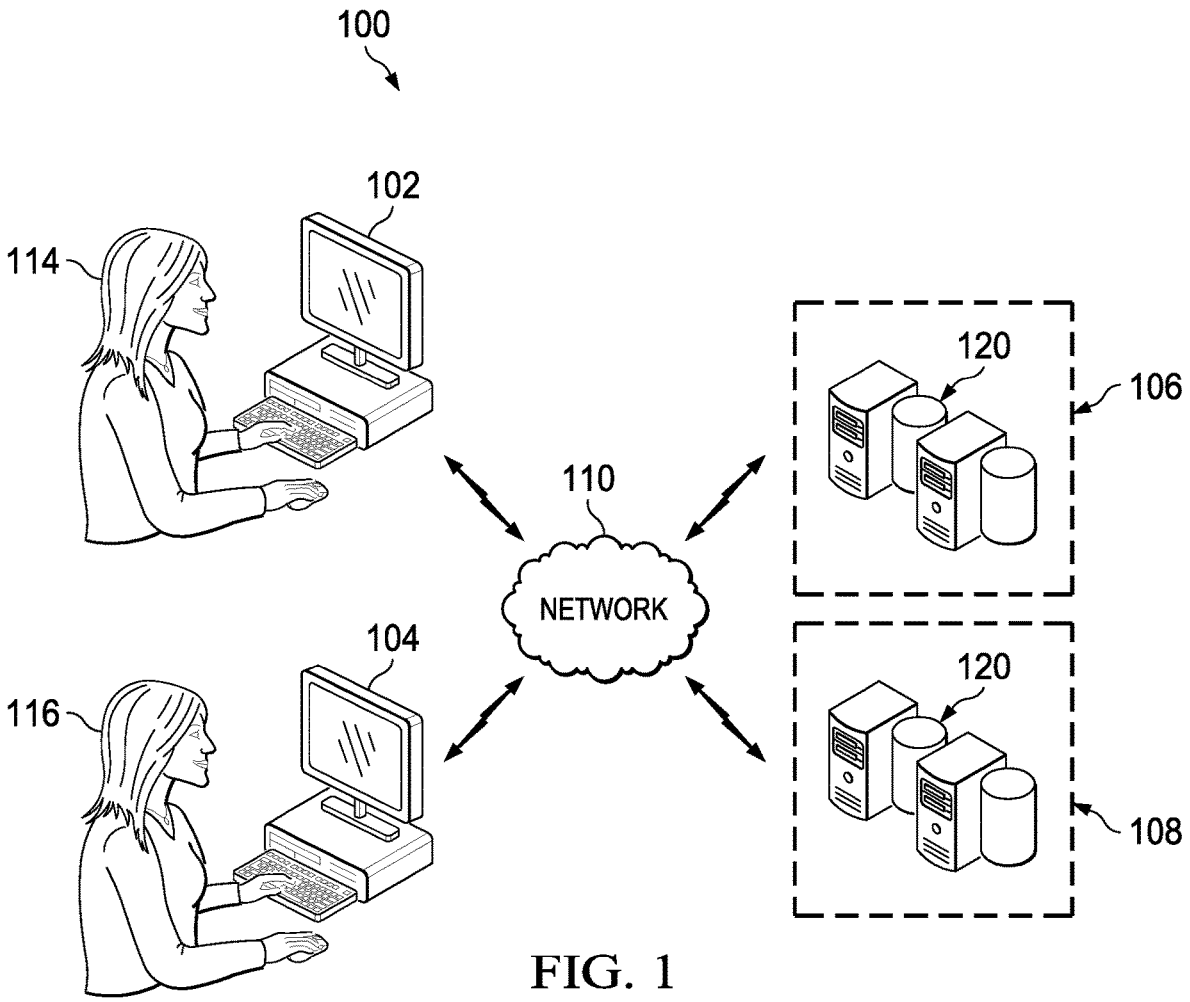
FIG. 1 depicts an environment architecture of an example computer-implemented system that can execute implementations of the present disclosure.

FIG. 1 depicts an environment architecture of an example computer-implemented system 100 that can execute implementations of the present disclosure. In the depicted example, the example system 100 includes a client device 102, a client device 104, a network 110, and a cloud environment 106 and a cloud environment 108. The cloud environment 106 may include one or more server devices and databases (e.g., processors, memory). In the depicted example, a user 114 interacts with the client device 102, and a user 116 interacts with the client device 104.

In some examples, the client device 102 and/or the client device 104 can communicate with the cloud environment 106 and/or cloud environment 108 over the network 110. The client device 102 can include any appropriate type of computing device, for example, a desktop computer, a laptop computer, a handheld computer, a tablet computer, a personal digital assistant (PDA), a cellular telephone, a network appliance, a camera, a smart phone, an enhanced general packet radio service (EGPRS) mobile phone, a media player, a navigation device, an email device, a game console, or an appropriate combination of any two or more of these devices or other data processing devices. In some implementations, the network 110 can include a large computer network, such as a local area network (LAN), a wide area network (WAN), the Internet, a cellular network, a telephone network (e.g., PSTN) or an appropriate combination thereof connecting any number of communication devices, mobile computing devices, fixed computing devices and server systems.

In some implementations, the cloud environment 106 include at least one server and at least one data store 120. In the example of FIG. 1, the cloud environment 106 is intended to represent various forms of servers including, but not limited to, a web server, an application server, a proxy server, a network server, and/or a server pool. In general, server systems accept requests for application services and provides such services to any number of client devices (e.g., the client device 102 over the network 110).

In accordance with implementations of the present disclosure, and as noted above, the cloud environment 106 can host applications and databases running on host infrastructure. In some instances, the cloud environment 106 can include multiple cluster nodes that can represent physical or virtual machines. A hosted application and/or service can run on VMs hosted on cloud infrastructure. In some instances, one application and/or service can run as multiple application instances on multiple corresponding VMs, where each instance is running on a corresponding VM.

Figure 2:
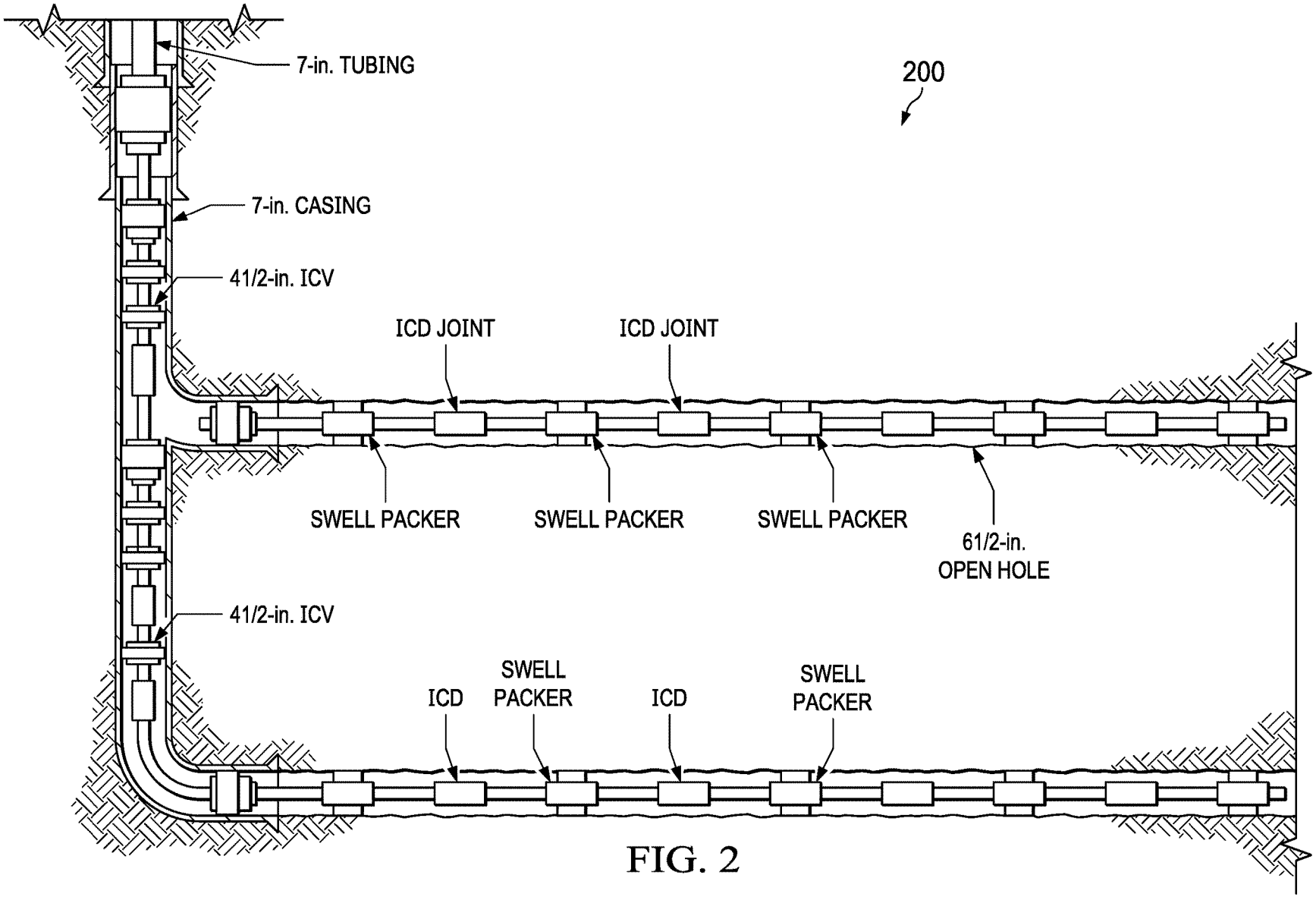
FIG. 2 illustrates an example lower completion of a wellbore with ICDs installed in two laterals, in accordance with example implementations of this disclosure.

FIG. 2 illustrates an example lower completion 200 of a wellbore with ICDs installed in two laterals, in accordance with example implementations of this disclosure. The lower completion 200 includes swell packers, blank pipe, and ICD joint (the equalizing screen). The ICDs are installed to maintain uniform fluid flow in the wellbore. Depending on the fluid flow in the wellbore, some ICDS help maintain uniform fluid flow in the wellbore, and therefore contribute to the fluid flow, while other ICDs do not contribute to the fluid flow.

Figure 3:
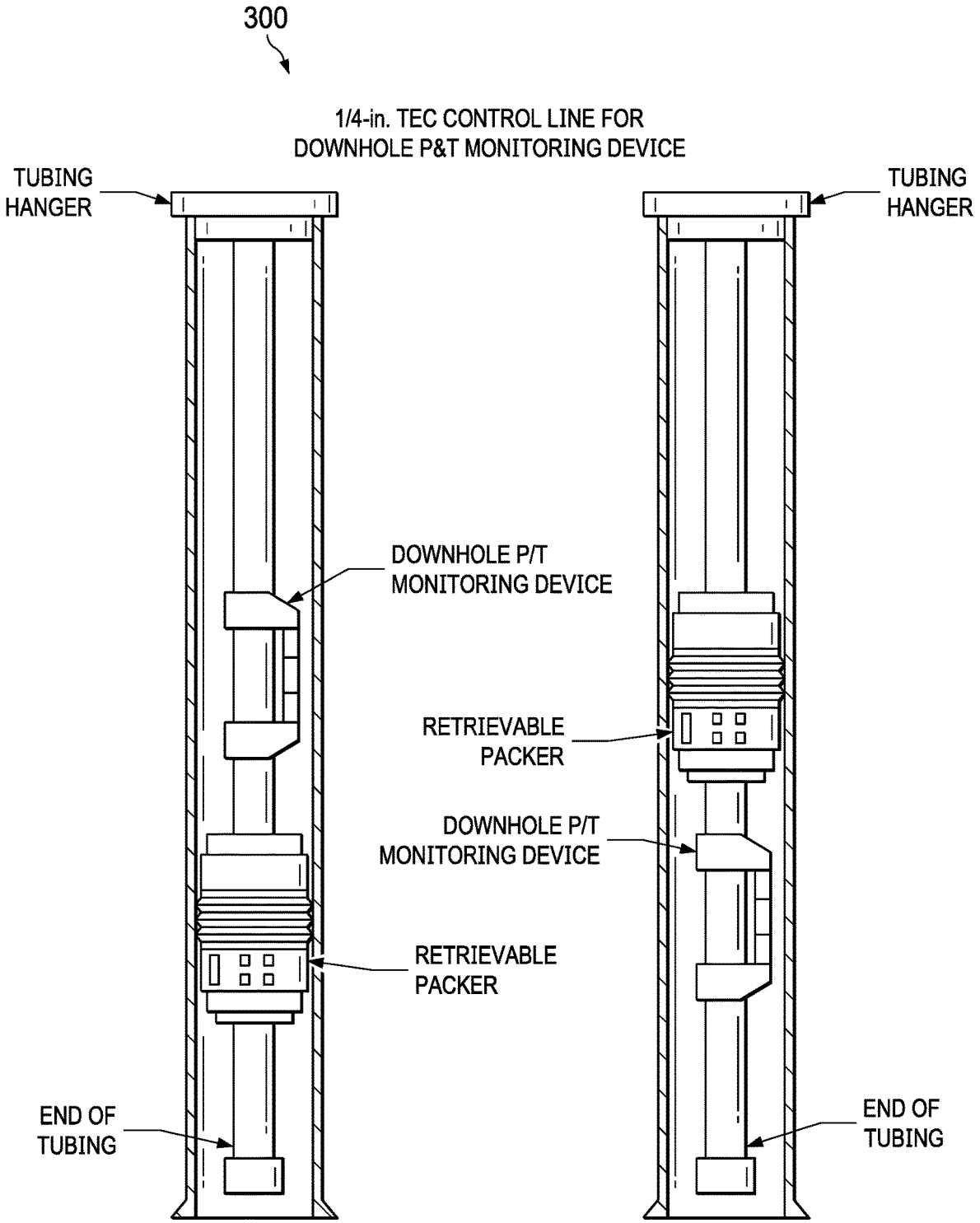
FIG. 3 illustrates an example tubing that has installed PDHMS, in accordance with example implementations of this disclosure.

FIG. 3 illustrates an example tubing 300 that has installed PDHMS, in accordance with example implementations of this disclosure. The pressure and temperature gauges of the PDHMS are installed on side pocket mandrels and are connected to a surface panel by electrical cord. In some implementations, the data collected by gauges of the PDHMS can be transmitted from the surface panel to the cloud environment 106 or 108 in FIG. 1, or the data can be collected manually from the field.

Figure 4:
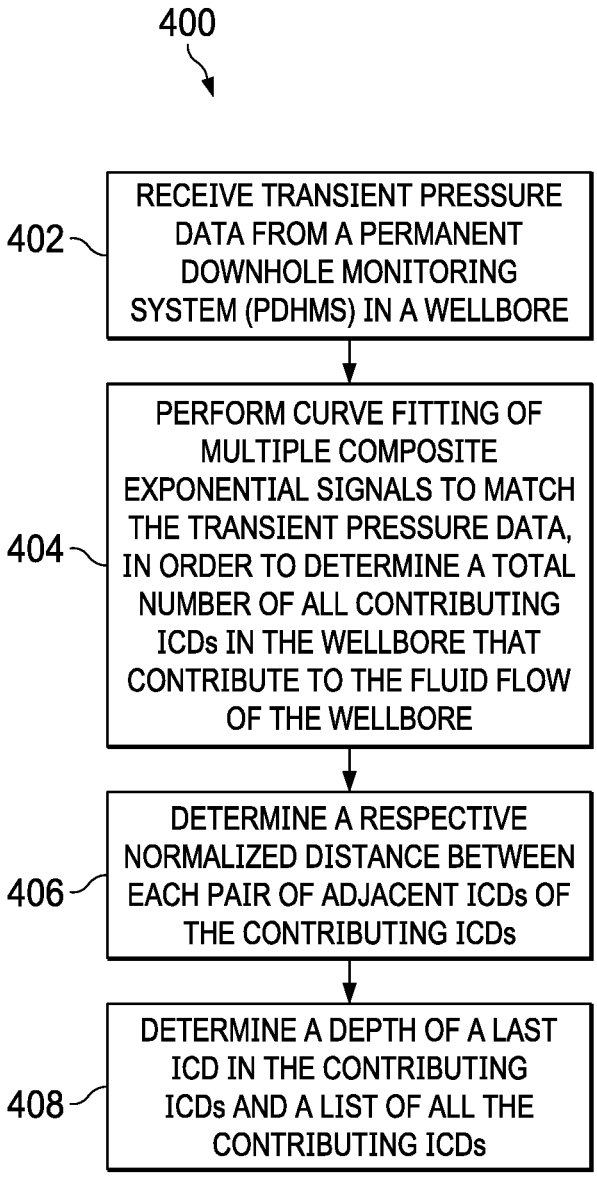
FIG. 4 illustrates an example flowchart of determining contributing ICDs using transient pressure data from a PDHMS in a wellbore, in accordance with example implementations of this disclosure.

FIG. 4 illustrates an example flowchart 400 of determining contributing ICDs using transient pressure data from a PDHMS in a wellbore, in accordance with example implementations of this disclosure.

At 402, transient pressure data is received from a PDHMS in a wellbore. In some implementations, the transient pressure data is a function of time. The transient pressure data can be collected from pressure gauges of the PDHMS. The total number of the multiple ICDs in the lower completion of the wellbore can be denoted as n.

At 404, curve fitting of at most n composite exponential signals is performed to match the transient pressure data, in order to determine a total number of all contributing ICDs in the wellbore that contribute to the fluid flow of the wellbore. In some implementations, the total number of the composite exponential signals resulted from the curve fitting can be denoted as m, where m is less than or equal to n. After the curve fitting, the combination of the m composite exponential signals is the closest to the transient pressure data, among all possible combinations of at most n composite exponential signals.

Figure 5:
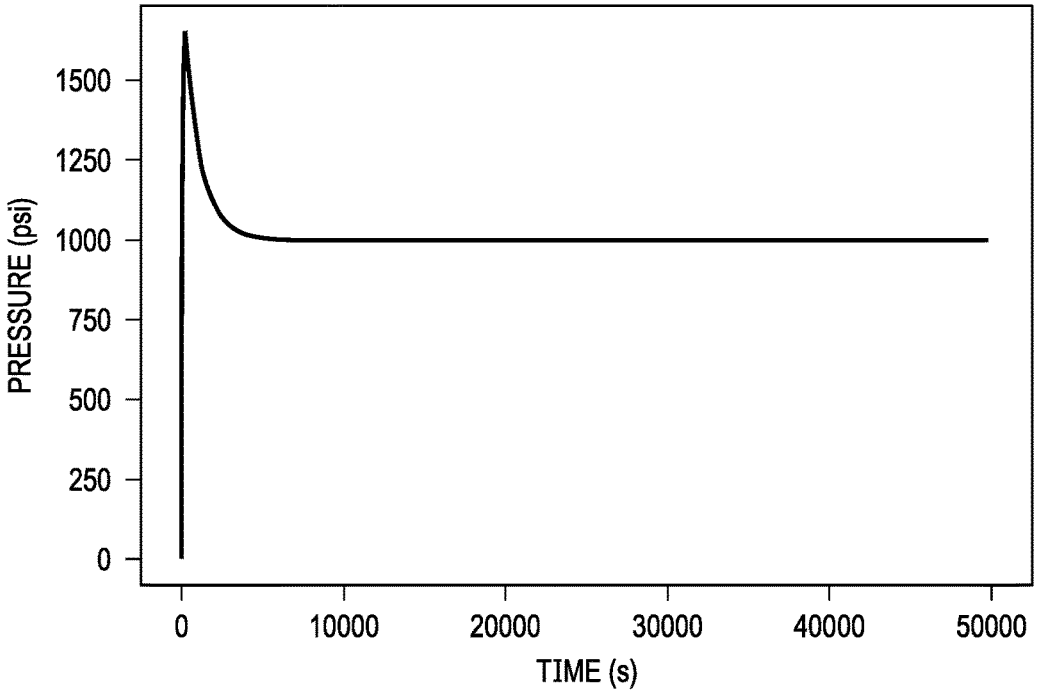
FIG. 5 illustrates an example composite exponential signal, in accordance with example implementations of this disclosure.

In some implementations, each composite exponential signal is represented by a formula of $f=[(P_r-P_f)e^{\lambda_1 t}+P_f]*(1-e^{\lambda_2 t})$, where $P_r$ is reservoir pressure, $P_f$ is bottom hole pressure at flowing conditions, $\lambda_1$ and $\lambda_2$ are exponential decline rates that are specific to each composite exponential signal, and t is time in seconds. An example composite exponential signal is shown in FIG. 5.

In some implementations, the curve fitting is performed by first choosing a subset of the n composite exponential signals, and then minimizing the difference between the transient pressure data and the combined composite exponential signals in the subset of the n composite exponential signals. This is done by changing $\lambda_1$ and $\lambda_2$ for each composite exponential signal of the subset of the n composite exponential signals. All the composite exponential signals in the subset of the n composite exponential signals are combined by taking the maximum of all the composite exponential signals in the subset of the n composite exponential signals at every time instant. The aforementioned procedure is then performed for all possible subsets of the n composite exponential signals, and the subset of the n composite exponential signals that produces the smallest difference between the transient pressure data and the combined composite exponential signals in the subset of the n composite exponential signals is chosen as the output of the curve fitting process. The number of the composite exponential signals in the subset of the n composite exponential signals that produces the smallest difference is then determined to be the number of ICDs in the wellbore that contribute to the fluid flow of the wellbore. These ICDs that contribute to the fluid flow of the wellbore are called contributing ICDs.

Figure 6:
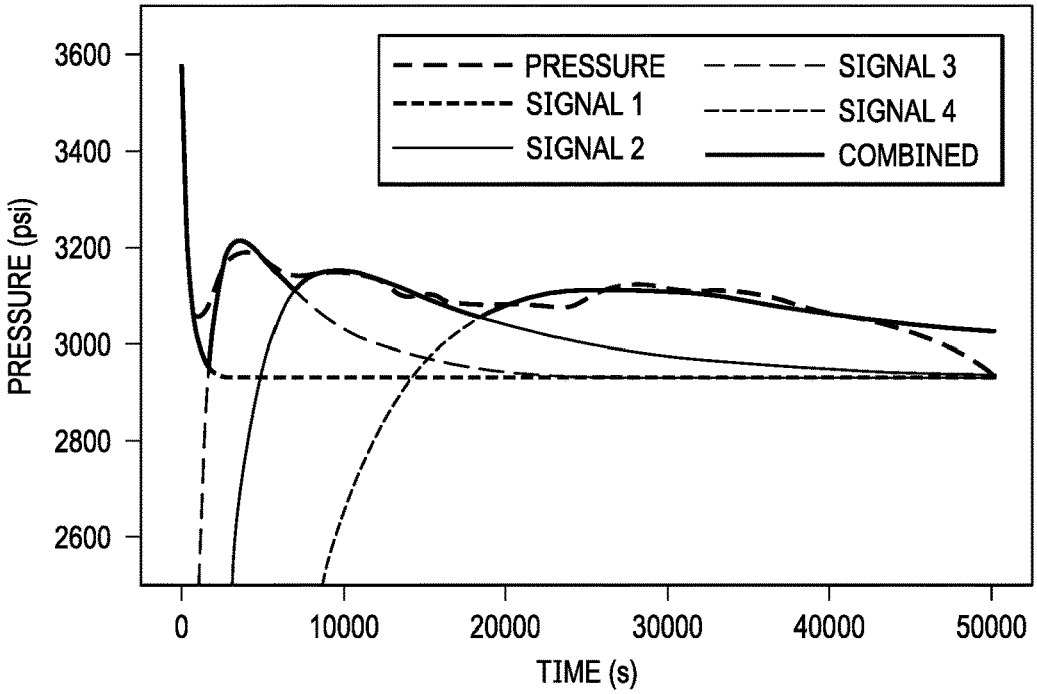
FIG. 6 illustrates example result of using curve fitting to determine the total number of contributing ICDs, in accordance with example implementations of this disclosure.

An example result of the curve fitting is shown in FIG. 6, where four composite exponential signals are the number of composite exponential signals that produce the smallest difference among combinations of all possible subsets of the n composite exponential signals. Therefore in this example, the total number of contributing ICDs is four.

At 406, a respective normalized distance between each pair of adjacent ICDs of the contributing ICDs is determined. In some implementations, first a ratio is determined for each of the contributing ICDs whose total number is determined at step 404. The ratio is represented by a formula of $$\text{ratio}_i = \frac{\log(\lambda_{1ICDi})}{\sum \log(\lambda_{1ICDi})},$$

where i is a respective index of each of the contributing ICDs, and $\lambda_{1_{ICDi}}$ is determined in step 404 during the curve fitting process. When i is less than the total number of the contributing ICDs determined in step 404, the ratio represents the normalized distance between an ith ICD and an (i+1)th ICD in the contributing ICDs. Note that the ratio of the last ICD of the contributing ICDs is not calculated because there is no other contributing ICDs after the last ICD of the contributing ICDs.

At 408, a depth of a last ICD in the contributing ICDs and a list of all the contributing ICDs are determined. In some implementations, the depth of an ICD is the length of the path along the trajectory of the wellbore from the surface to the ICD. Given the total number of contributing ICDs that is determined in step 404 and the respective normalized distance between each pair of adjacent ICDs of the contributing ICDs that is determined in step 406, first all possible combinations of the first and the last contributing ICDs from the n ICDs in the wellbore are determined. Then for each combination of the first and the last contributing ICDs, the depths of all the contributing ICDs corresponding to that combination of the first and the last contributing ICDs are predicted using the formula of $depth_{intermediateICD}=(depth_{firstICD}-depth_{lastICD})*ratio_{intermediateICD}+depth_{previousICD}$, where $depth_{firstICD}$ represents a depth of the first contributing ICD, $depth_{lastICD}$ represents a depth of the last contributing ICD, $ratio_{intermediateICD}$ represents the respective ratio of the intermediate ICD, and $depth_{previousICD}$ represents a depth of an ICD immediately before the intermediate ICD. Next the ICD with actual depth that is closest to the predicted depth of the last contributing ICD is determined to be the last contributing ICD for that combination of the first and the last contributing ICDs. This generates a difference between the actual depth and the predicted depth of the last contributing ICD, for that combination of the first and the last contributing ICDs. The aforementioned procedure is then repeated for all possible combinations of the first and the last contributing ICDs from the n ICDs in the wellbore, in order to generate a set of candidates of the last contributing ICD, with each candidate having an associated set of contributing ICDs, as well as an associated difference between the actual depth and the predicted depth of the last contributing ICD. The candidate with the smallest difference between the actual depth and the predicted depth of the last contributing ICD is determined to be the last contributing ICD, and the set of contributing ICDs associated with the determined last contributing ICD can be used to generate a list of all ICDs that contribute to the fluid flow in the wellbore.

As an example, consider a wellbore with five ICDs. It is determined, using step 404 described above, that three of the five ICDs are contributing ICDs. Therefore two ratios can be determined using step 406 described above, with the first ratio representing the normalized distance between the first contributing ICD and the second contributing ICD, and the second ratio representing the normalized distance between the second contributing ICD and the third (and last) contributing ICD. Next all possible subsets of three contributing ICDs from the five ICDs in the wellbore are listed in Table 1 below. For each subset, a depth of the last contributing ICD is predicted using step 408 described above, and compared against the actual depth of the corresponding last contributing ICD of that subset. The difference between the actual depth and the predicted depth of the last contributing ICD of that subset is recorded in Table 1 as a score for that subset. This scoring process is performed for all 10 subsets in Table 1, and the subset with the smallest score is determined to have the three contributing ICDs.

TABLE 1

| Subset | ICD1 | ICD2 | ICD3 | ICD4 | ICD5 | Score |
|---|---|---|---|---|---|---|
| 1 | Y | Y | Y | | | |
| 2 | Y | Y | | Y | | |
| 3 | Y | Y | | | Y | |
| 4 | Y | | Y | Y | | |
| 5 | Y | | Y | | Y | |
| 6 | Y | | | Y | Y | |
| 7 | | Y | Y | Y | | |

TABLE 1-continued

| Subset | ICD1 | ICD2 | ICD3 | ICD4 | ICD5 | Score |
|---|---|---|---|---|---|---|
| 8 | | Y | | Y | Y | |
| 9 | | Y | Y | | Y | |
| 10 | | | Y | Y | Y | |

Figure 7:
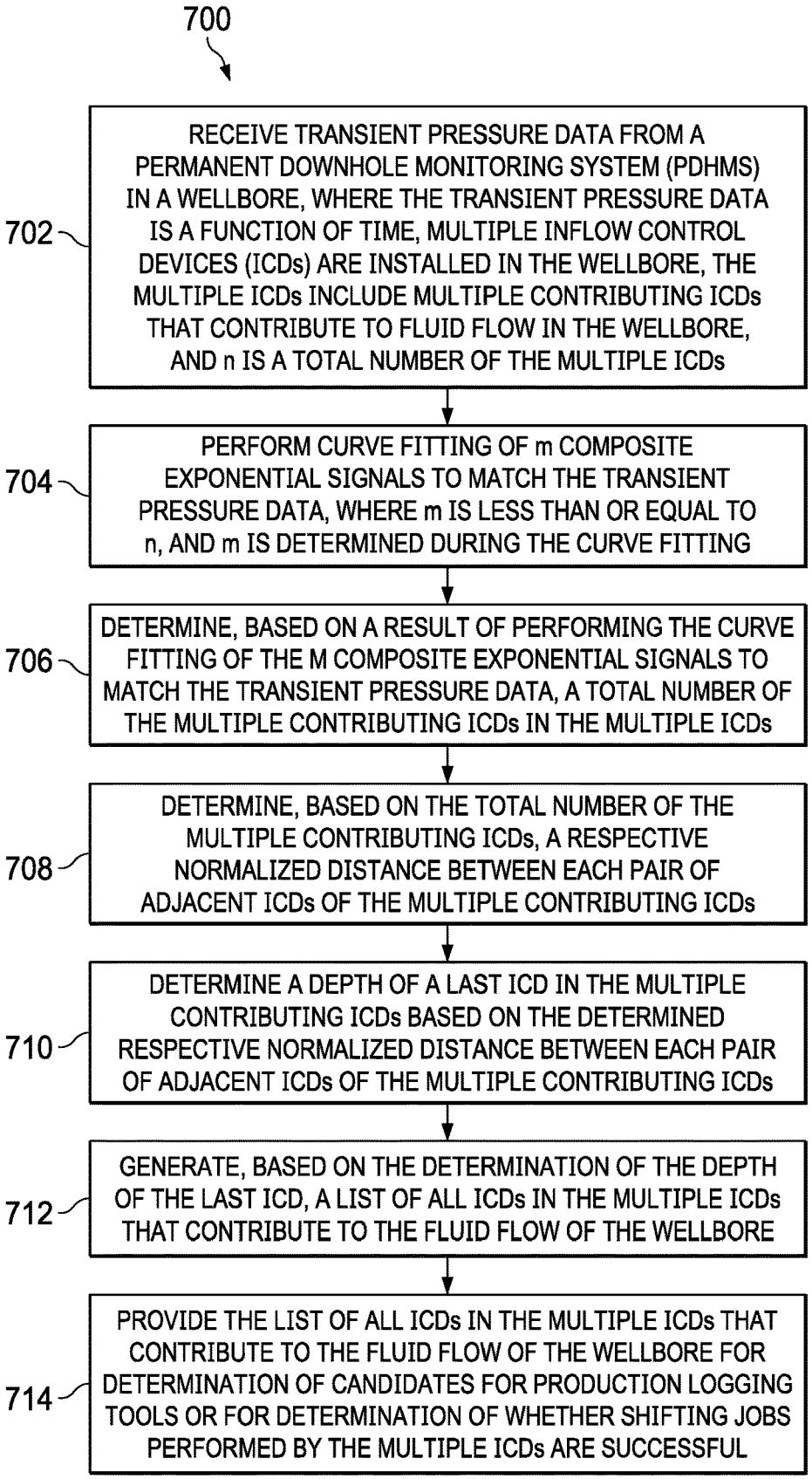
FIG. 7 is a flowchart illustrating an example of a method for determining contributing ICDs using transient pressure data from a PDHMS in a wellbore, in accordance with example implementations of this disclosure.

FIG. 7 illustrates an example method 700 for implementing the determination of contributing ICDs using transient pressure data from a PDHMS in a wellbore.

At 702, a computer system receives transient pressure data from a permanent downhole monitoring system (PDHMS) in a wellbore, where the transient pressure data is a function of time, multiple inflow control devices (ICDs) are installed in the wellbore, the multiple ICDs include multiple contributing ICDs that contribute to fluid flow in the wellbore, and n is a total number of the multiple ICDs.

At 704, the computer system performs curve fitting of m composite exponential signals to match the transient pressure data, where m is less than or equal to n, and m is determined during the curve fitting.

At 706, the computer system determines, based on a result of performing the curve fitting of the m composite exponential signals to match the transient pressure data, a total number of the multiple contributing ICDs in the multiple ICDs.

At 708, the computer system determines, based on the total number of the multiple contributing ICDs, a respective normalized distance between each pair of adjacent ICDs of the multiple contributing ICDs.

At 710, the computer system determines a depth of a last ICD in the multiple contributing ICDs based on the determined respective normalized distance between each pair of adjacent ICDs of the multiple contributing ICDs.

At 712, the computer system generates, based on the determination of the depth of the last ICD, a list of all ICDs in the multiple ICDs that contribute to the fluid flow of the wellbore.

At 714, the computer system provides the list of all ICDs in the multiple ICDs that contribute to the fluid flow of the wellbore for determination of candidates for production logging tools or for determination of whether shifting jobs performed by the multiple ICDs are successful.

Figure 8:
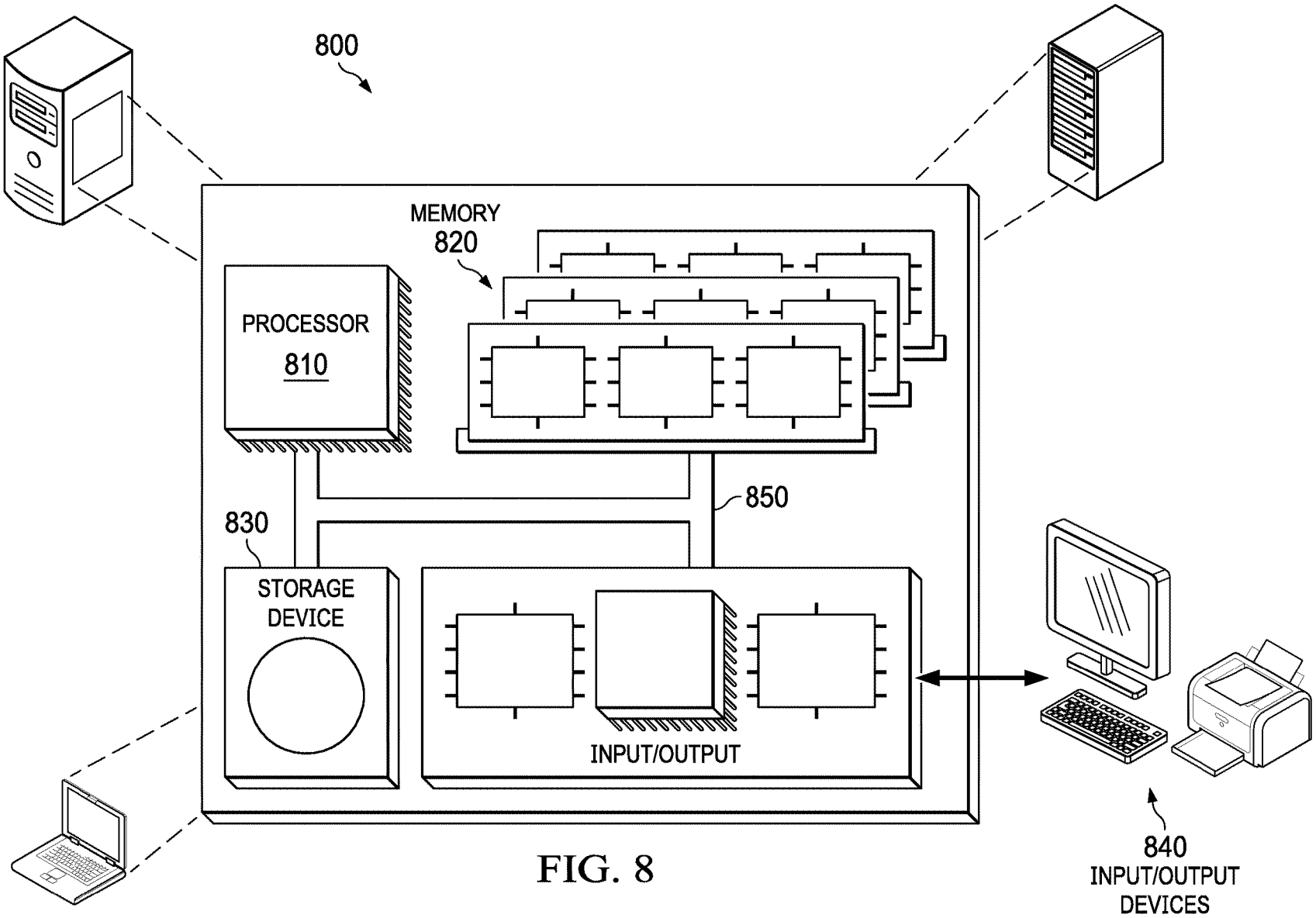
FIG. 8 is a schematic illustration of example computer systems that can be used to execute implementations of the present disclosure.

FIG. 8 illustrates a schematic diagram of an example computing system 800. The system 800 can be used for the operations described in association with the implementations described herein. For example, the system 800 may be included in any or all of the server components discussed herein. The system 800 includes a processor 810, a memory 820, a storage device 830, and an input/output device 840. The components 810, 820, 830, and 840 are interconnected using a system bus 850. The processor 810 is capable of processing instructions for execution within the system 800. In some implementations, the processor 810 is a single-threaded processor. The processor 810 is a multi-threaded processor. The processor 810 is capable of processing instructions stored in the memory 820 or on the storage device 830 to display graphical information for a user interface on the input/output device 840.

The memory 820 stores information within the system 800. In some implementations, the memory 820 is a computer-readable medium. The memory 820 is a volatile memory unit. The memory 820 is a non-volatile memory unit. The storage device 830 is capable of providing mass storage for the system 800. The storage device 830 is a computer-readable medium. The storage device 830 may be a floppy disk device, a hard disk device, an optical disk device, or a tape device. The input/output device 840 provides input/output operations for the system 800. The input/output device 840 includes a keyboard and/or pointing device. The input/output device 840 includes a display unit for displaying graphical user interfaces.

Certain aspects of the subject matter described here can be implemented as a method. Transient pressure data is received from a permanent downhole monitoring system (PDHMS) in a wellbore. The transient pressure data is a function of time. Multiple inflow control devices (ICDs) are installed in the wellbore. The multiple ICDs include multiple contributing ICDs that contribute to fluid flow in the wellbore, and n is a total number of the multiple ICDs. Curve fitting of m composite exponential signals is performed to match the transient pressure data, where m is less than or equal to n, and m is determined during the curve fitting. A total number of the multiple contributing ICDs in the multiple ICDs is determined based on a result of performing the curve fitting of the m composite exponential signals to match the transient pressure data. A respective normalized distance between each pair of adjacent ICDs of the multiple contributing ICDs is determined based on the total number of the multiple contributing ICDs. A depth of a last ICD in the multiple contributing ICDs is determined based on the determined respective normalized distance between each pair of adjacent ICDs of the multiple contributing ICDs. A list of all ICDs in the multiple ICDs that contribute to the fluid flow of the wellbore is generated based on the determination of the depth of the last ICD. The list of all ICDs in the multiple ICDs that contribute to the fluid flow of the wellbore is provided for determination of candidates for production logging tools or for determination of whether shifting jobs performed by the multiple ICDs are successful.

An aspect taken alone or combinable with any other aspect includes the following features. Each of the m composite exponential signals is represented by a formula of $f=[(P_r-P_f)e^{\lambda_1 t}+P_f]*(1-e^{\lambda_2 t})$, where $P_r$ is reservoir pressure, $P_f$ is bottom hole pressure at flowing conditions, $\lambda_1$ and $\lambda_2$ are exponential decline rates that are specific to each of the m composite exponential signals, and t is time in seconds.

An aspect taken alone or combinable with any other aspect includes the following features. Performing the curve fitting of the m composite exponential signals to match the transient pressure data includes changing $\lambda_1$ and $\lambda_2$ for each of the m composite exponential signals and taking the maximum value across the m composite exponential signals as combination of the m composite exponential signals at each time instant.

An aspect taken alone or combinable with any other aspect includes the following features. Determining the total number of the multiple contributing ICDs includes determining that the total number of the multiple contributing ICDs is equal to m.

An aspect taken alone or combinable with any other aspect includes the following features. Determining the respective normalized distance between each pair of adjacent ICDs of the multiple contributing ICDs includes determining, for each of the multiple contributing ICDs, a respective ratio represented by a formula of $$\text{ratio}_i = \frac{\log(\lambda_{1ICDi})}{\sum \log(\lambda_{1ICDi})},$$

where i is a respective index of each of the multiple contributing ICDs, and when i is less than the total number of the multiple contributing ICDs, the respective ratio represents the respective normalized distance between an ith ICD and an (i+1)th ICD in the multiple contributing ICDs.

An aspect taken alone or combinable with any other aspect includes the following features. Determining the depth of the last ICD in the multiple contributing ICDs includes determining a first ICD based on the last ICD and the determined total number of the multiple contributing ICDs.

An aspect taken alone or combinable with any other aspect includes the following features. A depth of an intermediate ICD between the first ICD and the last ICD is determined by a formula of $\text{depth}_{intermediateICD}=(\text{depth}_{firstICD}-\text{depth}_{lastICD})*\text{ratio}_{intermediateICD}+\text{depth}_{previousICD}$, where $\text{depth}_{firstICD}$ represents a depth of the first ICD, $\text{depth}_{lastICD}$ represents a depth of the last ICD, $\text{ratio}_{intermediateICD}$ represents the respective ratio of the intermediate ICD, and $\text{depth}_{previousICD}$ represents a depth of an ICD immediately before the intermediate ICD.

Certain aspects of the subject matter described in this disclosure can be implemented as a non-transitory computer-readable medium storing instructions which, when executed by a hardware-based processor perform operations including the methods described here.

Certain aspects of the subject matter described in this disclosure can be implemented as a computer-implemented system that includes one or more processors including a hardware-based processor, and a memory storage including a non-transitory computer-readable medium storing instructions which, when executed by the one or more processors performs operations including the methods described here.

The features described can be implemented in digital electronic circuitry, or in computer hardware, firmware, software, or in combinations of them. The apparatus can be implemented in a computer program product tangibly embodied in an information carrier (e.g., in a machine-readable storage device, for execution by a programmable processor), and method operations can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. Elements of a computer can include a processor for executing instructions and one or more memories for storing instructions and data. Generally, a computer can also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a cathode ray tube (CRT) or liquid crystal display (LCD) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, for example, a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

In addition, the logic flows depicted in the figures do not require the particular order shown, or sequential order, to achieve desirable results. In addition, other operations may be provided, or operations may be eliminated, from the described flows, and other components may be added to, or removed from, the described systems. Accordingly, other implementations are within the scope of the following claims.

The preceding figures and accompanying description illustrate example processes and computer-implementable techniques. But system 100 (or its software or other components) contemplates using, implementing, or executing any suitable technique for performing these and other tasks. It will be understood that these processes are for illustration purposes only and that the described or similar techniques may be performed at any appropriate time, including concurrently, individually, or in combination. In addition, many of the operations in these processes may take place simultaneously, concurrently, and/or in different orders than as shown. Moreover, system 100 may use processes with additional operations, fewer operations, and/or different operations, so long as the methods remain appropriate.

In other words, although this disclosure has been described in terms of certain implementations and generally associated methods, alterations and permutations of these implementations and methods will be apparent to those skilled in the art. Accordingly, the above description of example implementations does not define or constrain this disclosure. Other changes, substitutions, and alterations are also possible without departing from the spirit and scope of this disclosure.

What is claimed is:

1. A computer-implemented method, comprising:

receiving transient pressure data from a permanent downhole monitoring system (PDHMS) in a wellbore, wherein the transient pressure data is a function of time, wherein a plurality of inflow control devices (ICDs) are installed in the wellbore, wherein the plurality of ICDs include a plurality of contributing ICDs that contribute to fluid flow in the wellbore, and wherein n is a total number of the plurality of ICDs;

performing curve fitting of m composite exponential signals to match the transient pressure data, wherein m is less than or equal to n, and wherein m is determined during the curve fitting;

determining, based on a result of performing the curve fitting of the m composite exponential signals to match the transient pressure data, a total number of the plurality of contributing ICDs in the plurality of ICDs;

determining, based on the total number of the plurality of contributing ICDs, a respective normalized distance between each pair of adjacent ICDs of the plurality of contributing ICDs;

determining a depth of a last ICD in the plurality of contributing ICDs based on the determined respective normalized distance between each pair of adjacent ICDs of the plurality of contributing ICDs;

determining, based on the determination of the depth of the last ICD, one or more ICDs in the plurality of ICDs that contribute to the fluid flow of the wellbore; and performing production logging operations of the wellbore using the one or more ICDs.

2. The computer-implemented method according to claim 1, wherein each of the m composite exponential signals is represented by a formula of $f=[(P_r-P_f)e^{\lambda_1 t}+P_f]*(1-e^{\lambda_2 t})$, where $P_r$ is reservoir pressure, $P_f$ is bottom hole pressure at flowing conditions, $\lambda_1$ and $\lambda_2$ are exponential decline rates that are specific to each of the m composite exponential signals, and t is time in seconds.

3. The computer-implemented method according to claim 2, wherein performing the curve fitting of the m composite exponential signals to match the transient pressure data comprises:

changing $\lambda_1$ and $\lambda_2$ for each of the m composite exponential signals; and taking the maximum value across the m composite exponential signals as combination of the m composite exponential signals at each time instant.

4. The computer-implemented method according to claim 1, wherein determining the total number of the plurality of contributing ICDs comprises determining that the total number of the plurality of contributing ICDs is equal to m.

5. The computer-implemented method according to claim 1, wherein determining the respective normalized distance between each pair of adjacent ICDs of the plurality of contributing ICDs comprises determining, for each of the plurality of contributing ICDs, a respective ratio represented by a formula of $$\text{ratio}_i = \frac{\log(\lambda_{1ICDi})}{\sum \log(\lambda_{1ICDi})},$$

wherein i is a respective index of each of the plurality of contributing ICDs, and wherein when i is less than the total number of the plurality of contributing ICDs, the respective ratio represents the respective normalized distance between an ith ICD and an (i+1)th ICD in the plurality of contributing ICDs.

6. The computer-implemented method according to claim 5, wherein determining the depth of the last ICD in the plurality of contributing ICDs comprises determining a first ICD based on (i) the last ICD and (ii) the determined total number of the plurality of contributing ICDs.

7. The computer-implemented method according to claim 6, wherein a depth of an intermediate ICD between the first ICD and the last ICD is determined by a formula of $depth_{intermediateICD}=(depth_{firstICD}-depth_{lastICD})*ratio_{intermediateICD}+depth_{previousICD}$, where $depth_{firstICD}$ represents a depth of the first ICD, $depth_{lastICD}$ represents a depth of the last ICD, $ratio_{intermediateICD}$ represents the respective ratio of the intermediate ICD, and $depth_{previousICD}$ represents a depth of an ICD immediately before the intermediate ICD.

8. A non-transitory, computer-readable medium storing one or more instructions executable by a computer system to perform operations comprising:

receiving transient pressure data from a permanent downhole monitoring system (PDHMS) in a wellbore, wherein the transient pressure data is a function of time, wherein a plurality of inflow control devices (ICDs) are installed in the wellbore, wherein the plurality of ICDs include a plurality of contributing ICDs that contribute to fluid flow in the wellbore, and wherein n is a total number of the plurality of ICDs;

performing curve fitting of m composite exponential signals to match the transient pressure data, wherein m is less than or equal to n, and wherein m is determined during the curve fitting;

determining, based on a result of performing the curve fitting of the m composite exponential signals to match the transient pressure data, a total number of the plurality of contributing ICDs in the plurality of ICDs;

determining, based on the total number of the plurality of contributing ICDs, a respective normalized distance between each pair of adjacent ICDs of the plurality of contributing ICDs;

determining a depth of a last ICD in the plurality of contributing ICDs based on the determined respective normalized distance between each pair of adjacent ICDs of the plurality of contributing ICDs;

determining, based on the determination of the depth of the last ICD, one or more ICDs in the plurality of ICDs that contribute to the fluid flow of the wellbore; and performing production logging operations of the wellbore using the plurality of candidate ICDs.

9. The non-transitory, computer-readable medium according to claim 8, wherein each of the m composite exponential signals is represented by a formula of $f=[(P_r-P_f)e^{\lambda_1 t}+P_f]*(1-e^{\lambda_2 t})$, where $P_r$ is reservoir pressure, $P_f$ is bottom hole pressure at flowing conditions, $\lambda_1$ and $\lambda_2$ are exponential decline rates that are specific to each of the m composite exponential signals, and t is time in seconds.

10. The non-transitory, computer-readable medium according to claim 9, wherein performing the curve fitting of the m composite exponential signals to match the transient pressure data comprises:

changing $\lambda_1$ and $\lambda_2$ for each of the m composite exponential signals; and taking the maximum value across the m composite exponential signals as combination of the m composite exponential signals at each time instant.

11. The non-transitory, computer-readable medium according to claim 8, wherein determining the total number of the plurality of contributing ICDs comprises determining that the total number of the plurality of contributing ICDs is equal to m.

12. The non-transitory, computer-readable medium according to claim 8, wherein determining the respective normalized distance between each pair of adjacent ICDs of the plurality of contributing ICDs comprises determining, for each of the plurality of contributing ICDs, a respective ratio represented by a formula of $$ratio_i = \frac{\log(\lambda_{1ICDi})}{\sum \log(\lambda_{1ICDi})},$$

wherein i is a respective index of each of the plurality of contributing ICDs, and wherein when i is less than the total number of the plurality of contributing ICDs, the respective ratio represents the respective normalized distance between an ith ICD and an (i+1)th ICD in the plurality of contributing ICDs.

13. The non-transitory, computer-readable medium according to claim 12, wherein determining the depth of the last ICD in the plurality of contributing ICDs comprises determining a first ICD based on (i) the last ICD and (ii) the determined total number of the plurality of contributing ICDs.

14. The non-transitory, computer-readable medium according to claim 13, wherein a depth of an intermediate ICD between the first ICD and the last ICD is determined by a formula of $depth_{intermediateICD}=(depth_{firstICD}-depth_{lastICD})*ratio_{intermediateICD}+depth_{previousICD}$, where $depth_{firstICD}$ represents a depth of the first ICD, $depth_{lastICD}$ represents a depth of the last ICD, $ratio_{intermediateICD}$ represents the respective ratio of the intermediate ICD, and $depth_{previousICD}$ represents a depth of an ICD immediately before the intermediate ICD.

15. A computer-implemented system, comprising:

one or more computers; and one or more computer memory devices interoperably coupled with the one or more computers and having tangible, non-transitory, machine-readable media storing one or more instructions that, when executed by the one or more computers, perform one or more operations comprising:

receiving transient pressure data from a permanent downhole monitoring system (PDHMS) in a wellbore, wherein the transient pressure data is a function of time, wherein a plurality of inflow control devices (ICDs) are installed in the wellbore, wherein the plurality of ICDs include a plurality of contributing ICDs that contribute to fluid flow in the wellbore, and wherein n is a total number of the plurality of ICDs;

performing curve fitting of m composite exponential signals to match the transient pressure data, wherein m is less than or equal to n, and wherein m is determined during the curve fitting;

determining, based on a result of performing the curve fitting of the m composite exponential signals to match the transient pressure data, a total number of the plurality of contributing ICDs in the plurality of ICDs;

determining, based on the total number of the plurality of contributing ICDs, a respective normalized distance between each pair of adjacent ICDs of the plurality of contributing ICDs;

determining a depth of a last ICD in the plurality of contributing ICDs based on the determined respective normalized distance between each pair of adjacent ICDs of the plurality of contributing ICDs;

determining, based on the determination of the depth of the last ICD, one or more ICDs in the plurality of ICDs that contribute to the fluid flow of the wellbore; and performing production logging operations of the wellbore using the plurality of candidate ICDs.

16. The computer-implemented system according to claim 15, wherein each of the m composite exponential signals is represented by a formula of $f=[(P_r-P_f)e^{\lambda_1 t}+P_f]*(1-e^{\lambda_2 t})$, where $P_r$ is reservoir pressure, $P_f$ is bottom hole pressure at flowing conditions, $\lambda_1$ and $\lambda_2$ are exponential decline rates that are specific to each of the m composite exponential signals, and t is time in seconds.

17. The computer-implemented system according to claim 16, wherein performing the curve fitting of the m composite exponential signals to match the transient pressure data comprises:

changing $\lambda_1$ and $\lambda_2$ for each of the m composite exponential signals; and taking the maximum value across the m composite exponential signals as combination of the m composite exponential signals at each time instant.

18. The computer-implemented system according to claim 15, wherein determining the total number of the plurality of contributing ICDs comprises determining that the total number of the plurality of contributing ICDs is equal to m.

19. The computer-implemented system according to claim 15, wherein determining the respective normalized distance between each pair of adjacent ICDs of the plurality of contributing ICDs comprises determining, for each of the plurality of contributing ICDs, a respective ratio represented by a formula of $$\text{ratio}_i = \frac{\log(\lambda_{1ICDi})}{\sum \log(\lambda_{1ICDi})},$$

wherein i is a respective index of each of the plurality of contributing ICDs, and wherein when i is less than the total number of the plurality of contributing ICDs, the respective ratio represents the respective normalized distance between an ith ICD and an (i+1)th ICD in the plurality of contributing ICDs.

20. The computer-implemented system according to claim 19, wherein determining the depth of the last ICD in the plurality of contributing ICDs comprises determining a first ICD based on (i) the last ICD and (ii) the determined total number of the plurality of contributing ICDs.

* * * * *